United States Patent [19]

Hailer et al.

[11] Patent Number: 4,932,657

[45] Date of Patent: Jun. 12, 1990

[54] SPORTS TRAINING DEVICE

[75] Inventors: Stephen D. Hailer; Thomas E. Wills, both of Wapakoneta, Ohio

[73] Assignee: Strike Zone Partnership, Wapakoneta, Ohio

[21] Appl. No.: 243,710

[22] Filed: Sep. 13, 1988

[51] Int. Cl.[5] ..... A63B 69/40

[52] U.S. Cl. ..... 273/26 A; 273/410

[58] Field of Search ..... 273/26 R, 26 A, 411, 273/410

[56] References Cited

U.S. PATENT DOCUMENTS

| | | | |
|---|---|---|---|
| 2,126,102 | 8/1938 | Fowler | 273/26 A |
| 3,312,467 | 4/1967 | Dawson | 273/26 A |
| 3,810,616 | 5/1974 | Murphy | 271/26 A |
| 3,858,878 | 1/1975 | Tassone | 273/26 A |
| 4,718,668 | 1/1988 | Schipske | 273/26 A |

OTHER PUBLICATIONS

Popular Mechanic, 8/1962, pp. 128–129.

Catalog; "Basketball Coaching and Training Aids", 1989 School Mail Order Catalog: Korney Board, Aids; Roxton, TX; pp. 16 and 52.

Catalog; Carron Net; 1988 Catalog; pp. 12, 18, 19 and 22.

Catalog; Gilman Gear 88; p.21.

Catalog; BSN Sports; Fall 1988; pp. 45, 71 and 95.

Catalog; Passon's Sports 1988 Fall Catalog; p. 37.

Catalog; Super-Net, Inc.; Chappaqua, N.Y.; pp. 3 and 10.

Catalog; "1988-89 Athletic Equipment Buyer's Guide", Morley Athletic Supply Co.; Amsterdam, NY; p. 7.

Catalog; "1989 Baseball Equipment Handbook", Western Athletic Supply; Riverside, CA; p. 63.

*Primary Examiner*—T. Brown

*Attorney, Agent, or Firm*—Renner, Kenner, Greive, Bobak, Taylor & Weber

[57] ABSTRACT

A training device (b 10) for receiving thrown, hit or kicked balls includes a main frame (11) carrying a target frame (14) defining an open target area which is backed by a net (15). The size of the open target area is adjustable so that the user may practice with target areas of varying sizes. Adjustment of the target size is made possible by the provision of horizontal and vertical frame members, the horizontal frame members (23) being slidably adjustable on the vertical frame members (19). A plurality of spaced apart grooves (27) are placed along the vertical frame members (19) and an elastic ban or O-ring (28) is selectively placed in a groove (27) to hold the horizontal frame members (23) in a predetermined position.

6 Claims, 2 Drawing Sheets

SPORTS TRAINING DEVICE

TECHNICAL FIELD

The present invention relates generally to a sports training device enabling the user to practice pitching or throwing a ball, such as a baseball or football, or to practice hitting or kicking a ball, such as a tennis ball or a soccer ball. More specifically, the device allows one to monitor the accuracy and consistency of pitching, hitting or kicking a ball aimed at a target area during a training session, with the additional ability of being able to adjust the size of the target area during such activity.

BACKGROUND ART

An integral part of many sports which utilize a ball is the accurate and consistent placement of the ball either by pitching, hitting or kicking. The baseball pitcher, for example, must pitch a baseball into the area known as the strike zone, which has a width defined by home plate and a height defined by the distance between the batter's armpits and knees. The height of this area will vary considerably from batter to batter, and the pitcher must be able to adjust his pitch accordingly. Regular practice is necessary in order to be proficient at such an exercise. For the baseball pitcher, this practice should include pitching to different size strike zones. Similarly, for other sports where accuracy and consistency is important, the trainee must practice his throw, hit or kick for placement of a ball in various positions.

The simplest system used by the pitcher, who may wish to practice without the help of an additional person to catch the ball, is to paint a target on a wall. The trainee could then throw the ball at the target, and can visually determine whether the ball was thrown in the desired area. It should be apparent, however, that the painted target could not be adjusted for differing target areas. Moreover, since the target was painted on a wall, the user was confined to practice at that location as opposed to, for example, being able to practice at other sports facilities.

Another somewhat common practice device is known as a pitch-back, which consists of a square frame covered with a taut material. A ball thrown at the pitch-back would rebound toward the trainee, who could then catch the ball and throw it again. Often, a target would be painted on the resilient material, so as to show the accuracy of the pitched ball. This device proved to be an improvement over other systems primarily in that it was portable. However, the pitch-back was still not adjustable for varying target areas. Further, while the pitch-back was useful for the trainee who was throwing with only one practice ball, the trainee with many practice balls does not need the rebounding capabilities. In fact, many trainees do not want the bother of having to chase down and retrieve the rebounding ball; instead desiring to concentrate on the pitch, not the catch. Moreover, unless one was bothering to count, which itself can be a training distraction, there was no way to keep track of exactly how many times a ball was placed within the target area.

To date, there exists no device useful to a sports trainee which allows practice in pitching, hitting or kicking a ball, which has an adjustable target area, is easily transportable, and which is capable of providing an indication of the number of times a ball is placed within the desired target area.

DISCLOSURE OF THE INVENTION

It is, therefore, a primary object of the invention to provide a sports training device with an adjustable ball receiving target area.

It is another object of the present invention to provide a sports training device, as above, which may be disassembled for convenient and easy transportation, and yet maintain structural integrity when assembled.

It is a further object of the invention to provide a sports training device, as above, which is capable of providing an indication of the number of times a trainee accurately places a ball in the desired target area.

These and other objects of the invention, as well as the advantages thereof over existing and prior art forms, which will become apparent in view of the following specification, are accomplished by means hereinafter described and claimed.

In general, a training device for receiving a thrown, hit or kicked ball includes a main frame which supports a target frame. The target frame defines an open target area and a net surrounds that area so that balls passing through the open target area are trapped by the net. Means are provided on the target frame so that the target area may be adjusted, as desired.

PREFERRED EMBODIMENT FOR CARRYING OUT THE INVENTION

Figure 1:
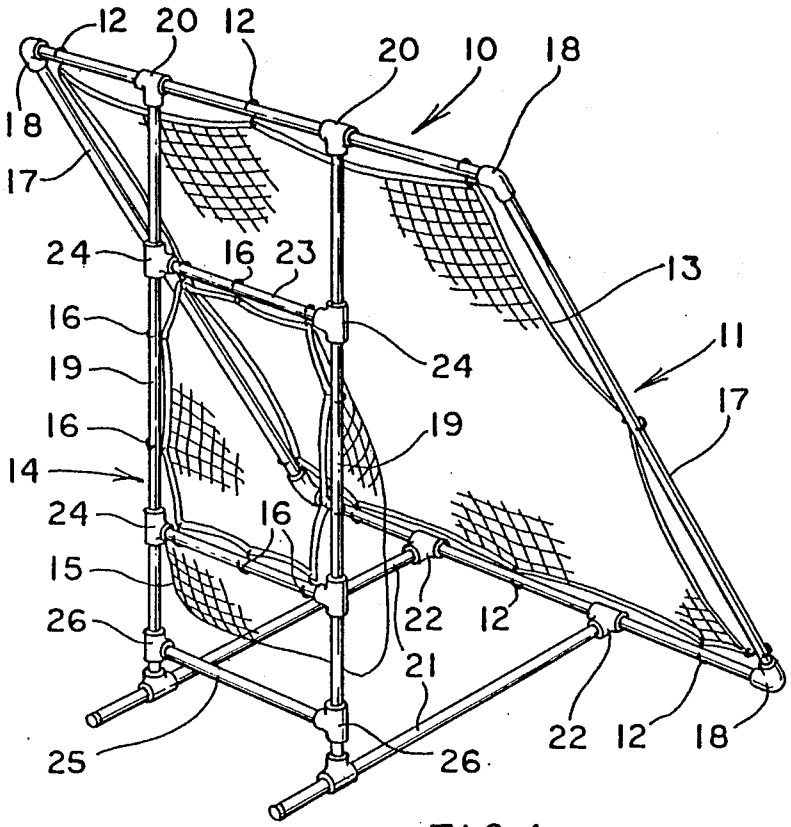
FIG. 1 is a perspective view of a sports training device embodying the concept of the present invention.

A sports training device embodying the concept of the present invention is indicated generally by the numeral 10 in FIG. 1 of the attached drawings. While the device 10 itself, or with suitable modifications, could be utilized to practice any sport, such as throwing footballs, hitting tennis balls, or kicking soccer balls, without departing from the spirit of the invention, the concept will be described herein as used as a baseball pitching training aide. The device 10 includes a main frame generally indicated by the numeral 11, which can support in any conventional manner, as by S-hooks 12, a net 13. Device 10 also includes a target frame indicated generally by the numeral 14, which includes a target area that may also be backed by a target net 15, carried in any conventional manner, as by S-hooks 16.

Main frame 11 can be made up of a plurality of framing sections 17, each joined by a connector 18. In the embodiment of the invention disclosed in the drawings, the main frame 11 has four frame sections 17, each joined by a connector 18 having a ninety degree angle, resulting in a square or rectangular main frame 11. It should be appreciated that any shape main frame 11 may be obtained by varying the size of the frame sections 17, as well as the angle or configuration of the connectors 18.

The frame sections 17 and connectors 18 allow easy assembling and disassembling of the device 10. If more frame sections 17 and connectors 18 are used, the device may be broken down into even smaller pieces. In this way, the device may be easily transported and set up wherever it is desired. A sports trainee may thus utilize the device 10 at his home and at a sports or training field.

The target frame 14 can also be made-up of vertically oriented modular framing sections, such as, target frame sections 19, which may be of any length and which are shown as being attached to the top of main frame 11 by T-shaped connectors 20. Each T-shaped connector 20 can be slidably positioned along the length of the top main frame section 17, until it is in the desired location to define the sides of the target frame and thus the target area. For example, for baseball the distance between vertical sections 19 would be adjusted to the width of home plate.

Vertical frame sections 19 of target frame 14 are supported at their lower end by horizontal frame members 21 extending outwardly from the lower frame section 17 of main frame 11. Suitable T-connectors 22 attach the horizontal frame members 21 to main frame 11 and to vertical frame sections 19.

Horizontal bar members 23 extend between vertical frame sections 19 to define, with vertical sections 19, a target area. Bar members 23 carry net 15 and can be attached to vertical sections 19, as by T-connectors 24. As will hereinafter be described, the position of bar members 23 can be adjusted to, for example in the baseball environment, the size of the batter's strike zone, and therefore the pitcher's target can be adjusted. A lower horizontal bar 25 may also be provided between vertical sections 19, and connected as by T-connectors 26, to provide overall stability to the target frame 14.

Figure 2:
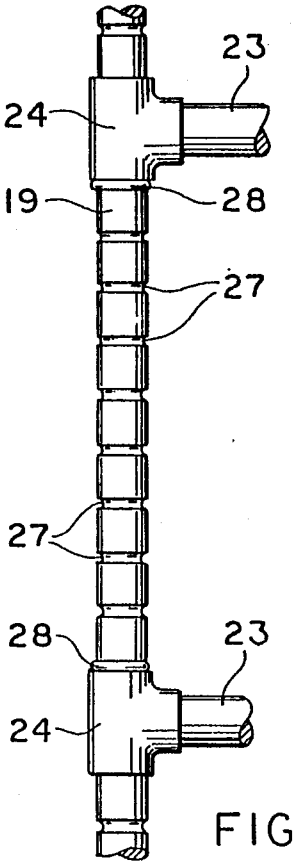
FIG. 2 is an enlarged view of a portion of a modular framing section of the sports training device showing the manner in which the size of the target area may be adjusted.

As best shown in FIG. 2, vertical frame sections 19 of target frame 14 are provided with a plurality of spaced connector locating grooves 27. Connectors 24 may be positioned along the length of framing sections 19 at selected locations to vary the vertical height of the target area. O-rings 28, made of any suitable elastic material, may then be moved into position in the grooves adjacent to the connectors 24 to lock the connector 24 in place so that the horizontal bar members 23 will not move under the shock of being struck by a ball. Thus, the target area may be adjusted to any desired size, in particular it may be adjusted to various sizes to approximate the strike zone for baseball players of varying heights.

It should be appreciated that other portions of device 10 could be likewise provided with similar adjustment features. For example, horizontal main frame sections 17 could have location grooves therein rendering the width of the target area likewise adjustable which may have particular applicability to sports other than baseball.

During a training session, a trainee adjusts the target area to approximate the area wherein it is desired to practice placing a ball. A number of balls may be pitched, hit or kicked depending on the sport being practiced. Those which enter the desired target area are trapped by the target net 15. To determine how many times the target area was successfully breached, it is only necessary to count the balls in the target net 15. Balls which miss the target area are caught by the main frame net 13, making retrieval of such balls easy.

Figure 4:
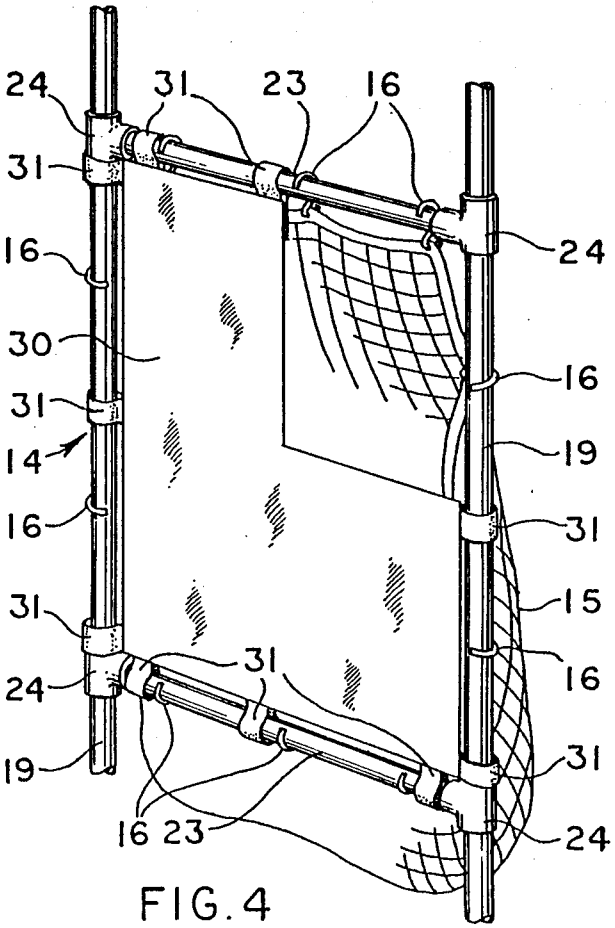
FIG. 4 is an enlarged perspective view of the target area of the device shown in FIG. 1, and employing the sectioning panel shown in FIG. 3.
Figure 3:
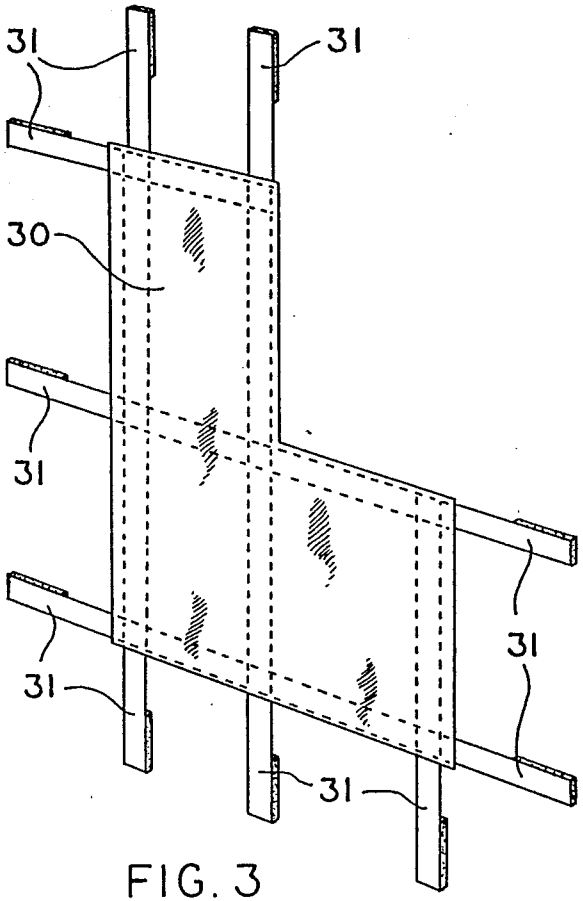
FIG. 3 is a perspective view of a sectioning panel used as an adjunct to the device shown in FIG. 1.

FIG. 3 shows a sectioning panel indicated by the numeral 30, which may be used as an adjunct with the device 10, and specifically to redefine the target area. By any suitable attachment means such as hook and eye straps 31, the sectioning panel 30 is positioned so as to cover up a portion of the target area (FIG. 4). In this way, the trainee may further refine his training to an even greater degree. The sectioning panel 30 shown in the drawings would be useful for training a baseball pitcher in that when placed in position in target area, it covers up approximately three quarters of the total target area. The sectioning panel 30 may be rotated to cover up any three of the four quarter sections of target area 14. In this way, the baseball pitcher is able to have a strike zone approximating that of a given batter, and further have a device to help develop his pitching of a baseball to the upper and lower, inside and outside, corners of the strike zone. Thus, by using the sectioning panel 30, the present invention provides a training device for developing the skills necessary to achieve proficiency of a pitcher not merely to hit the strike zone, but also to hit a specific portion of the strike zone.

It should be apparent that a sports training device embodying the concept of the invention disclosed herein carries out the various objects of the invention and otherwise constitutes an advantageous contribution to the art.

We claim:

1. A training device for receiving thrown, hit or kicked balls comprising a main frame, a target frame carried by said main frame and defining an open target area, said target frame including means for adjusting the size of said open target area, said target area including two generally vertically oriented spaced frame members carried by said main frame and two generally horizontally oriented spaced frame members carried by said vertically oriented frame members, said means for adjusting including a plurality of spaced grooves on said vertically oriented frame members, said horizontally oriented frame members being aligned with selected of said grooves, means to lock said horizontally oriented frame members at the location of said selected grooves, said means to lock including at least one elastic O-ring received in said selected of said grooves, and a net surrounding said open target area of said target frame to receive the balls passing through said open target area.

2. A training device, as in claim 1, wherein said main and target frames are modular sections joined by at least one connector.

3. A training device, as in claim 1, further comprising a second net backing said main frame.

4. A training device, as in claim 1, further comprising a sectioning panel attached to said target frame for limiting the size of said open target area.

5. A training device, as in claim 4, wherein said sectioning panel is divided into quarter portions, with at least one such portion permitting access to said open target area.

6. A training device, as in claim 4, wherein said sectioning panel is attached to said target frame by strap members.

* * * * *